US009862215B2

(12) United States Patent
Miller

(10) Patent No.: US 9,862,215 B2
(45) Date of Patent: Jan. 9, 2018

(54) PRINTER HEAD WITH AIRFLOW MANAGEMENT SYSTEM

(71) Applicant: NIKE, Inc., Beaverton, OR (US)

(72) Inventor: Todd W. Miller, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/365,227

(22) Filed: Nov. 30, 2016

(65) Prior Publication Data

US 2017/0080731 A1 Mar. 23, 2017

Related U.S. Application Data

(62) Division of application No. 14/884,994, filed on Oct. 16, 2015, now Pat. No. 9,545,805, which is a division of application No. 14/061,097, filed on Oct. 23, 2013, now Pat. No. 9,193,152.

(51) Int. Cl.

| | |
|---|---|
| ***B41J 11/00*** | (2006.01) |
| ***B41J 29/377*** | (2006.01) |
| ***B41J 2/01*** | (2006.01) |
| ***B41J 29/00*** | (2006.01) |

(52) U.S. Cl.
CPC ..... *B41J 29/377* (2013.01); *B41J 2/01* (2013.01); *B41J 29/00* (2013.01)

(58) Field of Classification Search
CPC ... B41J 29/377; B41J 29/00; B41J 2/01; B41J 2/00
See application file for complete search history.

(56) References Cited

U.S. PATENT DOCUMENTS

| | | | | |
|---|---|---|---|---|
| 6,203,152 | B1 | 3/2001 | Boleda et al. | |
| 6,464,328 | B1 | 10/2002 | Hiramatsu et al. | |
| 6,491,364 | B2 | 10/2002 | Pietrzyk et al. | |
| 6,561,620 | B2 | 5/2003 | Pietrzyk et al. | |
| 7,044,582 | B2 | 5/2006 | Fredrickson | |
| 7,594,712 | B2 | 9/2009 | Hasegawa | |
| 7,604,332 | B2 | 10/2009 | Nagashima | |
| 7,828,411 | B2 | 11/2010 | Inoue et al. | |
| 7,959,255 | B2 | 6/2011 | Kubo | |
| 8,172,353 | B2 | 5/2012 | Sugahara | |
| 8,246,144 | B2 | 8/2012 | Katano et al. | |
| 8,690,290 | B2 | 4/2014 | Masuda | |
| 2002/0057312 | A1* | 5/2002 | Watanabe | B41J 2/1408 347/56 |
| 2003/0067505 | A1 | 4/2003 | Kumagai | |
| 2003/0197752 | A1* | 10/2003 | McEltresh | B41J 2/025 347/21 |
| 2005/0219301 | A1* | 10/2005 | Suzuki | B41J 29/377 347/18 |

(Continued)

*Primary Examiner* — Patrick King
(74) *Attorney, Agent, or Firm* — Klarquist Sparkman, LLP

(57) ABSTRACT

A printing system includes a printer head with an airflow management system. The airflow management system includes an air splitter on the leading edge of the printer head and side members that extend the length of the printer head. The air splitter and members are positioned so that a gap is formed between the printer head and the air splitter and members. A vacuum fan positioned within a duct on top of the printer head can draw air through the gap at the leading edge of the printer head and return the air on the trailing side of the printer head. The airflow management system can permit increased printing distances.

9 Claims, 14 Drawing Sheets

(56) References Cited

U.S. PATENT DOCUMENTS

| | | | | |
|---|---|---|---|---|
| 2006/0109331 | A1 | 5/2006 | Hasegawa | |
| 2009/0002468 | A1 | 1/2009 | Ito | |
| 2011/0007113 | A1* | 1/2011 | Katano | B41J 29/12 347/40 |
| 2011/0181639 | A1 | 7/2011 | Leoni et al. | |
| 2011/0249060 | A1 | 10/2011 | Sakata et al. | |
| 2012/0081455 | A1* | 4/2012 | Kritchman | B41J 2/14 347/20 |
| 2012/0133708 | A1 | 5/2012 | Miller et al. | |
| 2013/0328963 | A1* | 12/2013 | Domae | B41J 29/377 347/18 |

* cited by examiner

PRINTER HEAD WITH AIRFLOW MANAGEMENT SYSTEM

CROSS-REFERENCE TO RELATED APPLICATIONS

This application is a divisional of U.S. patent application Ser. No. 14/884,994, filed Oct. 16, 2015, which is a divisional of U.S. patent application Ser. No. 14/061,097, filed Oct. 23, 2013, both of which are incorporated herein by reference in their entireties.

BACKGROUND

The present embodiments relate generally to printer heads and in particular to systems for managing airflow patterns around moving printer heads.

Printers are commonly used in printing graphics or text on to sheets of material. These sheets of printed material may be used for many purposes, including formation into articles of manufacture. The printer heads of these printers typically move at speeds sufficient to create turbulence around the printer head. This turbulence may negatively impact the print quality on the sheets, particularly if the sheet is textured or if the print head is positioned at a distance that exceeds current standards for recommended print distance.

Therefore, there is a need in the art for managing the airflow patterns around moving printer heads to reduce the impact of air flow on print quality, particularly over large print distances.

SUMMARY

A printing system includes a printer head with an airflow management system for reducing turbulence in the print gap (the space between the printer head and the print target.) The airflow management system includes an air splitter on the leading edge of the printer head and side members that extend the length of the printer head. The air splitter and members are positioned so that gaps are formed between the printer head and the air splitter and members. A vacuum fan positioned within a duct on top of the printer head can draw air through these gaps, particularly through the gap at the leading edge of the printer head, and return the air on the trailing side of the printer head. The airflow management system can permit increased printing distances through reduction of air pressure and turbulence in the print gap.

In one aspect, this disclosure provides a printer comprising a printer head, wherein the printer head is configured to translate, and wherein the printer head has a leading edge, a trailing edge, and a top that joins the leading edge with the trailing edge. The printer also comprises an airflow management system associated with the printer head. The airflow management system comprises an air splitter associated with and extending away from the leading edge so that a first gap is formed between the leading edge and the air splitter. The airflow management system also comprises a first side member, wherein the first side member extends from the leading edge to the trailing edge, and wherein the first side member is associated with the printer head so that a second gap is formed between the printer head and the first side member.

In another aspect, this disclosure provides a printer head comprising a housing, wherein the housing has a leading edge associated with the print direction, a trailing edge on an opposite side of the housing from the leading edge, and a top that extends from the leading edge to the trailing edge. The printer head also comprises at least one reservoir associated with the housing, wherein the reservoir contains a print medium. The printer head also comprises at least one nozzle associated with the housing, wherein the reservoir is in fluid communication with the at least one nozzle, and wherein the at least one nozzle is configured to dispense the print medium onto a print target. The printer head also comprises an airflow management system associated with the housing, wherein the airflow management system is configured to create a low turbulence region between the printer head and the print target. The airflow management system includes an air splitter associated with the leading edge so that a first gap is formed between the leading edge and the air splitter. The airflow management system also includes a first side member, wherein the first side member extends from the leading edge to the trailing edge, and wherein the first side member is associated with the printer head so that a second gap is formed between the printer head and the first side member.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

The foregoing and other objects, features, and advantages of the disclosed technology will become more apparent from the following detailed description, which proceeds with reference to the accompanying figures.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Additionally, throughout, relative and orientation terms such as "top", "bottom", "above", and "below" are to be understood with respect to the parts and embodiments shown in the figures. Moreover, in the figures, like reference numerals designate corresponding parts throughout the different views.

DETAILED DESCRIPTION

Printers are commonly used in printing on sheets of materials for use in manufacturing of articles, particularly consumer goods. Printing on the uneven surfaces of some of the materials used, such as natural or synthetic leather, texturized non-woven materials, or woven materials, poses challenges to the manufacturer. Among these challenges is positioning the sheets at an appropriate print distance from the printer head that can accommodate both the material and the limitations of print distance caused by airflow patterns around the printer head.

Print distance can impact the appearance of the printed graphic. For example, inkjet printers generally include nozzles that dispense ink in droplets. The droplets are intended to follow a specific trajectory to the article. By following the trajectory, the droplets land on the article in the intended pattern. If the droplets deviate from the specific trajectory, the pattern may be distorted. Over short print distances, such as less than 1.5 mm, many printers can maintain the specific trajectory within acceptable tolerances. However, at distances greater than about 1.5 mm, conventional printers may have a problem in maintaining the specific trajectory due to uncontrolled airflow patterns around the printer head, which is associated with a translating carriage. Together, the combination of the printer head and the carriage may be referred to as a truck.

Printer heads are not typically designed with airflow pattern management in mind. The printer head is typically box-shaped, with large, blunt surfaces at the leading and trailing edges of the box. The printer head also typically includes roughened surfaces with connectors, vents, and openings forming protrusions or depressions. Because of the boxy shape and irregular surfaces of the printer head, the movement of the truck generates turbulence, such as by tripping the flow with the protrusions and depressions, the movement of a blunt body through fluid, and typically generating Couette flow via the movement of the truck over the print target. When the turbulence occurs in the print gap, the space between the truck and the print target, the turbulence can move the ink droplets off of the intended specific trajectory, as will be discussed in greater detail below.

The term "graphic" as used throughout this detailed description and in the claims refers to any visual design elements including, but not limited to: photos, logos, text, illustrations, lines, shapes, patterns, images of various kinds as well as any combinations of these elements. Moreover, the term graphic is not intended to be limiting and could incorporate any number of contiguous or non-contiguous visual features. For example, in one embodiment, a graphic may comprise a logo that is applied to a small region of an article of footwear. In another embodiment, a graphic may comprise a large region of color that is applied over one or more regions, including the entirety, of an article of footwear.

Figure 1:
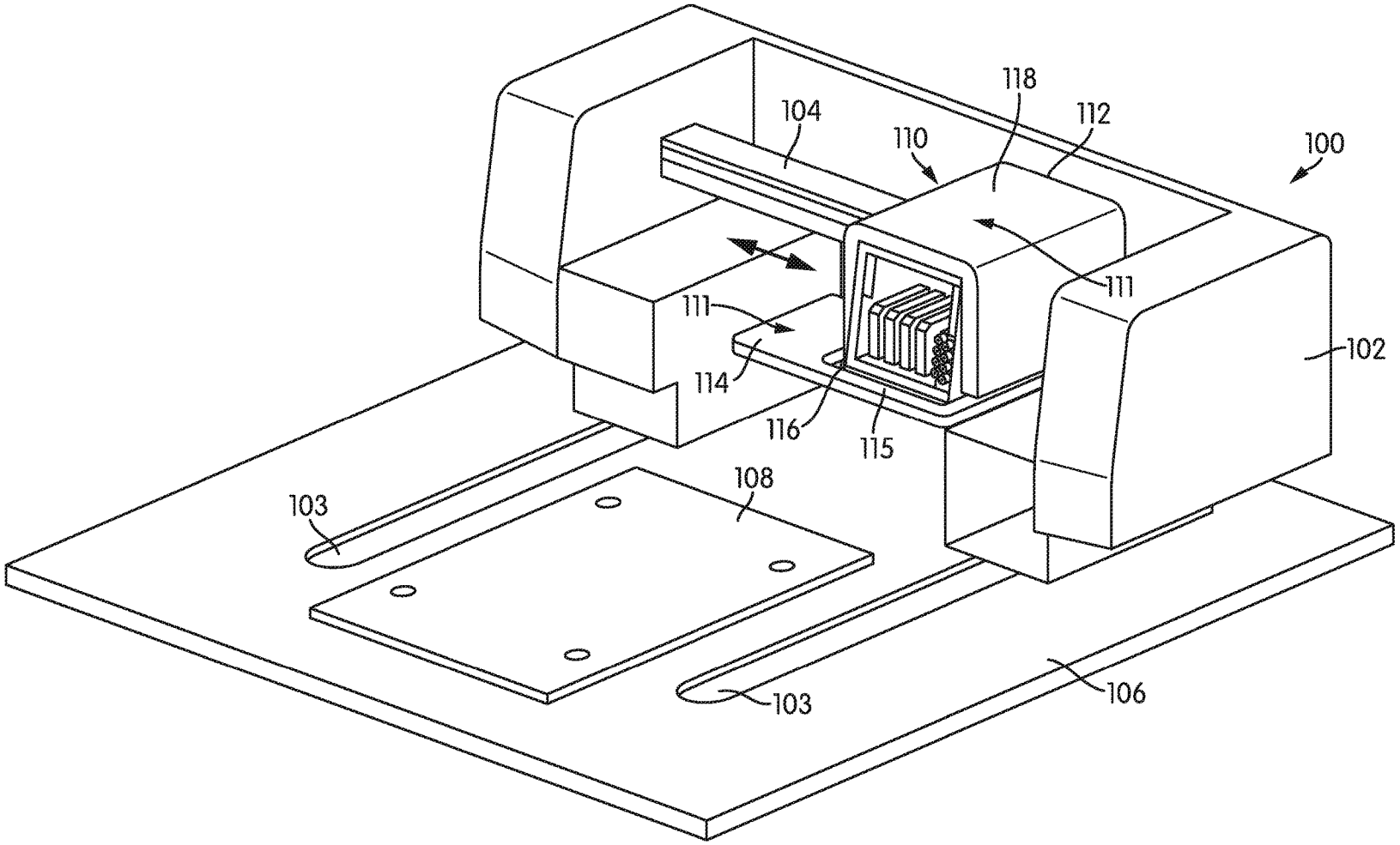
FIG. 1 is a schematic isometric view of a printer having a printer head utilizing an air splitter managing system.

FIG. 1 is a schematic view of an embodiment of a printer 100. In some embodiments, printer 100 is configured to print onto sheets of material. In some embodiments, such as the embodiment shown in FIG. 1, printer 100 may be intended for use with various kinds of three-dimensional articles. In some embodiments, printer 100 may include various kinds of provisions for applying graphics, or any type of design or image, to sheets of material, footwear, and/or apparel. Moreover, the process of applying graphics may occur during manufacturing of an article and/or after an article has been manufactured. In some embodiments, graphics may be applied to an article of footwear after the article of footwear has been manufactured into a three-dimensional form including an upper and sole structure. In some embodiments, printer 100 could be used at a retail location to apply user selected graphics to articles of footwear and/or articles of apparel. In other embodiments, the graphics may be applied to components of articles or sheets of material that are intended to be cut into components and assembled into articles.

Figure 2:
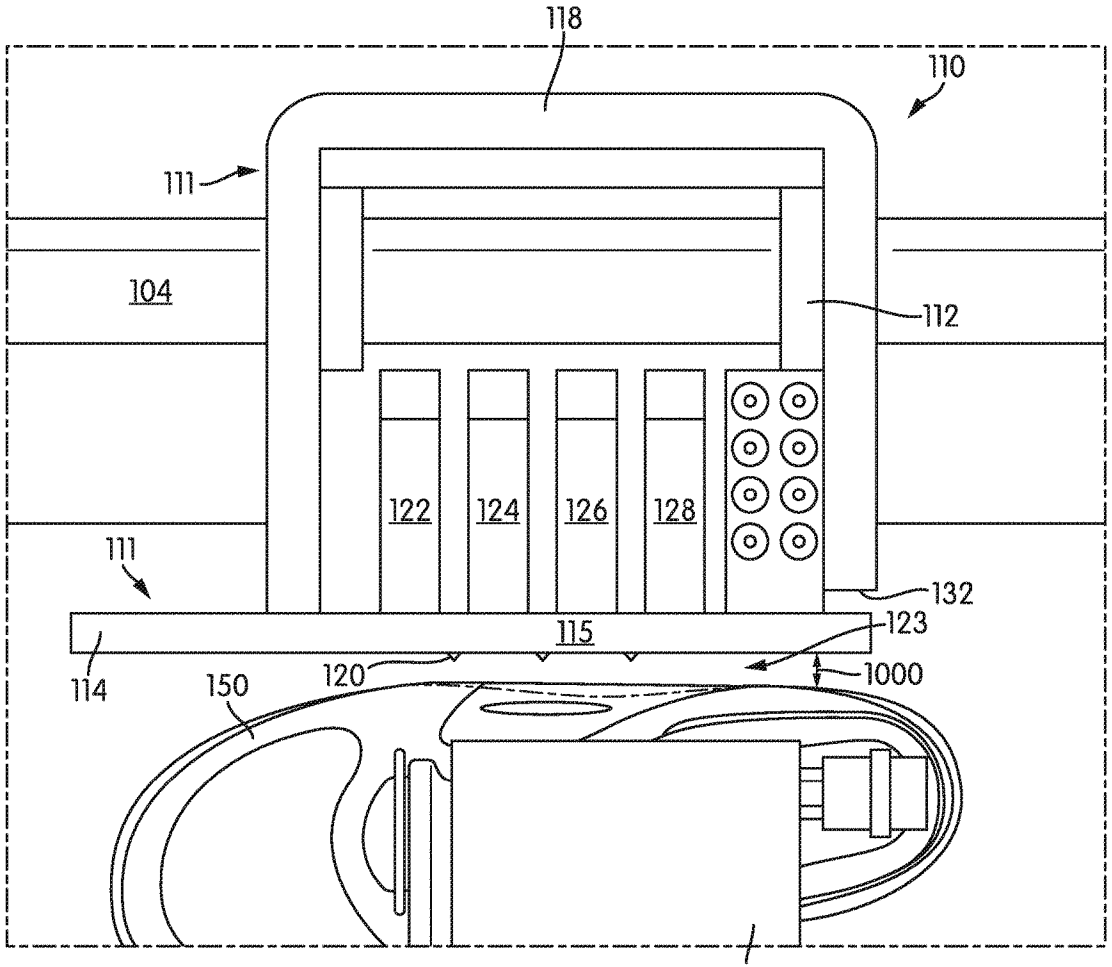
FIG. 2 is a schematic, enlarged side view of a printer head utilizing an air splitter managing system showing a printing medium positioned in a printing position.

For clarity, the following detailed description discusses an exemplary embodiment, in which printer 100 is used to apply graphics to article of footwear 150 (shown in FIG. 2). In this case, article of footwear 150, or simply article 150, may take the form of an athletic shoe, such as a running shoe. However, it should be noted that in other embodiments printer 100 may be used with any kind of print target, including fabrics, textiles, sheets of materials, component materials, finished articles, and other kinds footwear. While FIG. 1 shows a system adapted for use with a single article, it will be understood that printer 100 could be used to apply graphics to two or more articles, including articles or components that are later assembled to make an article of footwear.

Referring now in detail to the operation of printer 100, truck 110 includes a printer head 112 and a carriage, which is associated with a translating carriage. The carriage includes provisions to slidably mount printer head to a rail 104. In some embodiment, the carriage may also include provisions for cooling printer head 112, such as vents and cooling fans. For the sake of clarity, the carriage, carriage driving provisions, and carriage mounting provisions are not specifically shown or labeled in the figures.

Printer head 112 also includes or is configured to be in fluid communication with reservoirs of print medium such as ink, either in cartridges mounted directly to printer head 112 as shown in FIG. 2 or spaced apart from printer head 112 and connected to printer head 112 using any fluid communication connector, such as tubing. Spaced apart reservoirs are typically used with industrial sized printers, so that the reservoirs can contain much larger quantities of print medium. For the sake of simplicity, only ink as the print medium and cartridges as the reservoirs are discussed in this description, though a person of skill in the art will readily recognize that alternatives may be readily substituted.

Any number of cartridges may be associated with printer head 112, and the number of cartridges typically depends upon the color scheme utilized by printer 100. For example, a standard color scheme is CMYK, which is a well-known color scheme that provides four colors of ink (cyan, magenta, yellow, and black) that can be mixed to produce almost any other color or shade desired to be printed. In the embodiment shown in FIG. 2, four ink cartridges are associated with printer head: a first cartridge 122, a second cartridge 124, a third cartridge 126, and a fourth cartridge 128. However, in other embodiments, more or fewer cartridges may be provided. Increasing the number of cartridges directly mounted to printer head 112, however, may increase the amount of turbulence generated by the translation of printer head 112 on rail 104. Decreasing the number of cartridges may limit the available print colors.

Printer head 112 includes at least one nozzle 120 for dispensing the ink contained in the ink reservoir(s) onto the print target. In FIG. 2, the print target is shown as article 150. In FIG. 2, article 150 is positioned in a holder 155. Various embodiments of a holder similar to holder 155 are shown and described in Miller et al., U.S. Patent Publication Number 2014/0310891, titled "Systems and Methods for Printing to Articles of Footwear", published on Oct. 23, 2014, the disclosure of which is hereby incorporated by reference. While shown as an article of footwear, article 150 may be any type of article, as discussed above. Any number of nozzles 120 may be provided, but typically at least one nozzle 120 per ink reservoir is provided. While FIG. 2 shows three nozzles 120, the actual number of nozzles 120 in a system may be greater or less than three. Nozzles 120 may be in direct fluid communication with the ink reservoirs, in this embodiment, first cartridge 122, second cartridge 124, third cartridge 126, an fourth cartridge 128. However, in some embodiments, the ink cartridges may feed ink first into a mixing reservoir (not shown) and then the mixing reservoir is in direct fluid communication with nozzles 120. Additional details of printer 100 are provided below.

As shown in FIGS. 1 and 2, printer head 112 includes an airflow management system 111. Airflow management system 111 generally includes an air splitter 114, a side member 115, and a vacuum fan system 118. These individual components of airflow management 111 work in concert to minimize turbulence in a print gap 123, shown in FIG. 2. Print gap 123 is the space between printer head 112 and the print target, article 150. The height of print gap 123 is considered to be a print distance 1010. In conventional printers, print distance 1010 is constrained by the ability of the printer to effectively dispense the ink across print gap 123 without losing the integrity of the intended print pattern.

FIGS. 3-6 further explain the correlation between a print distance and print quality. Those in the art will recognize that printer heads typically print while printer head 212 is moving linearly along a rail from an initial position in one direction, i.e., print direction 2000, and returns to the initial position in the reverse or trailing direction (indicated by the arrow on printer head 212 in FIG. 5).

Figure 3:
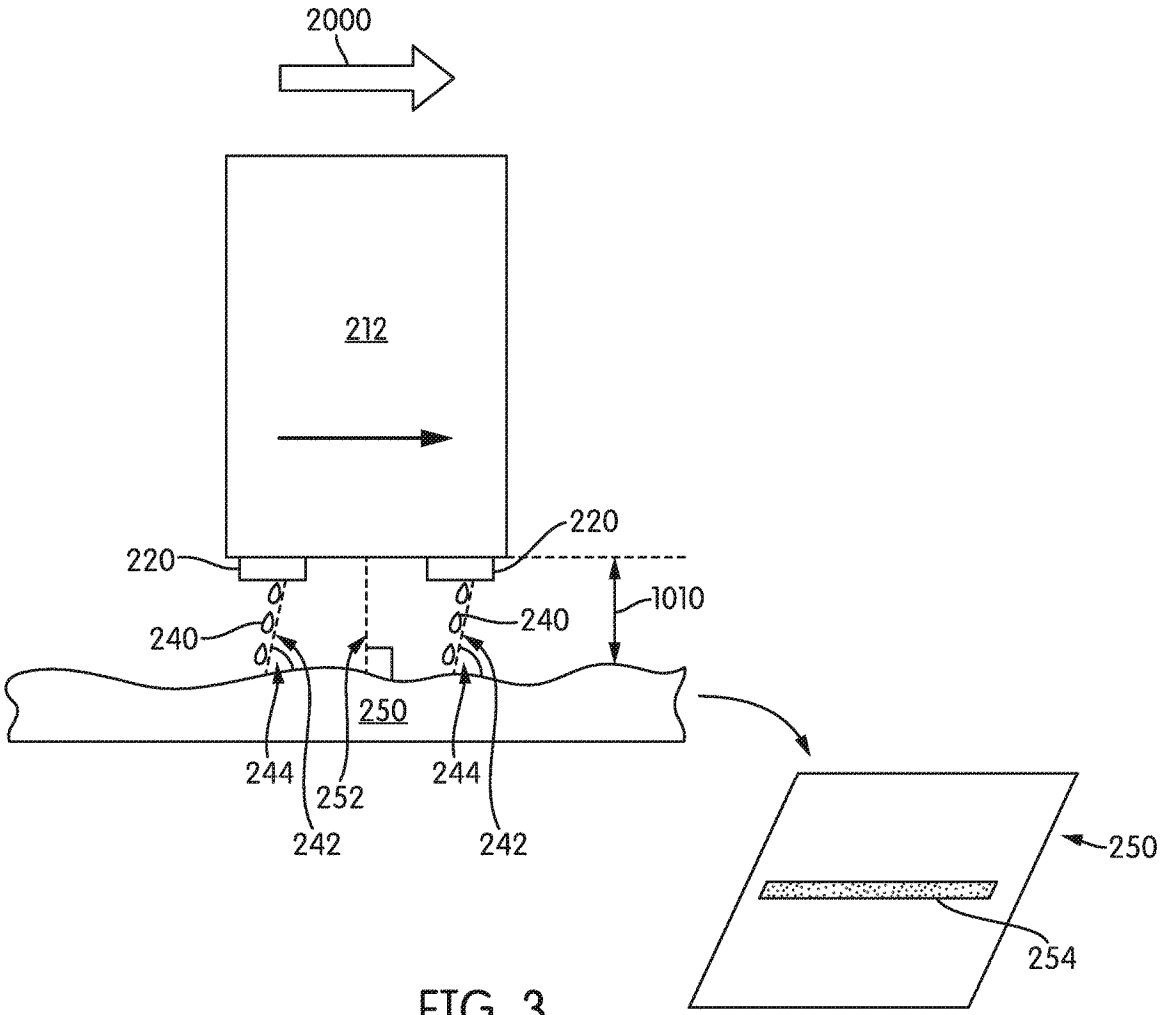
FIG. 3 is a schematic side view of a conventional printer head showing an ideal printing situation.

FIG. 3 shows an idealized print scenario using a conventional printer head 212 that is moving in print direction 2000. In FIG. 3, printer head 212 is positioned a conventional print distance 1010 from a print target 250. Printer head 212 includes nozzles 220 that are dispensing ink droplets 240 onto print target 250. Ink droplets 240 generally do not travel on a normal trajectory 252 towards print target 250. Instead, due to the movement of printer head 212, ink droplets 240 are propelled toward print target 250 along an intended print trajectory 242. When viewed from the reference frame of printer head 212, intended print trajectory 242 is at an angle 244 with respect to print target 250 to form an intended print pattern 254 on print target 250. In the scenario shown, intended print pattern 254 is a straight line with no wavy edges, occlusions, or voids in the print. With tolerances adjusted for real operating conditions, this idealized scenario is most possible when conventional print distance 1010 is relatively small; typically, an acceptable print pattern is attainable in conventional systems when print distance 1010 is 1.5 mm or less.

Figure 4:
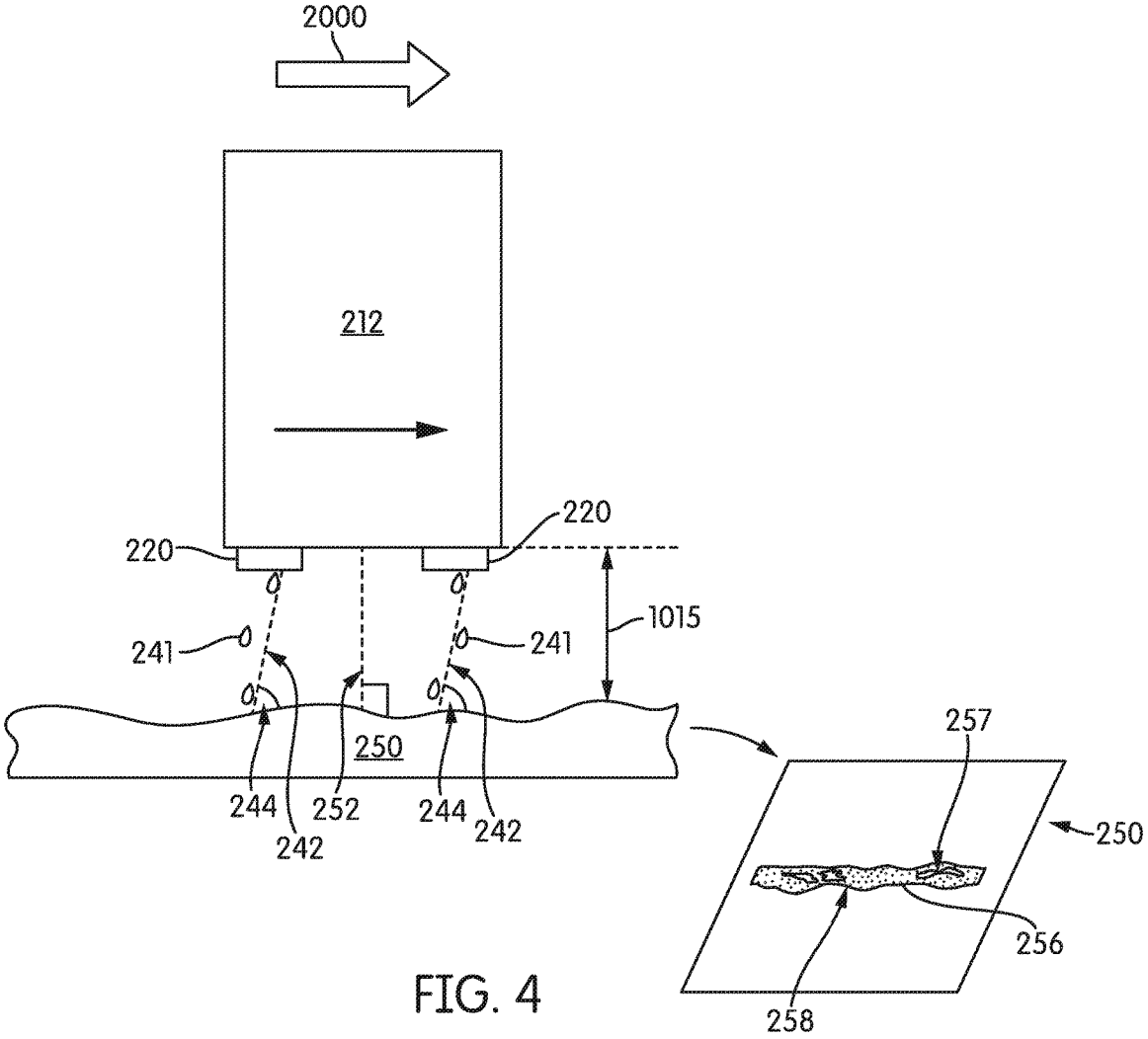
FIG. 4 is a schematic side view of a conventional printer head showing a typical printing situation.

FIG. 4 illustrates what can occur when an expanded print distance 1015 exceeds 1.5 mm. In FIG. 4, printer head 212 is positioned expanded print distance 1015 from a print target 250. Printer head 212 includes nozzles 220 that are dispensing ink droplets 241 onto print target 250. Ink droplets 241 are not intended to travel on a normal trajectory 252 towards print target 250; similar to FIG. 3, ink droplets 241 are intended to move along intended print trajectory 242 to print target 250. Instead, due to high pressure and turbulence in the print gap, ink droplets 241 cannot maintain intended trajectory 242. Ink droplets 241, due to the relatively small size and weight of ink droplets 241, are moved off course by the turbulence and other air currents in the print gap. As shown, ink droplets 241 do not all follow the same trajectory. Some of ink droplets 241 deviate from intended print trajectory 242. Though not shown, any of ink droplets 242 may move in any direction with respect to intended print trajectory 242, such as laterally, back towards nozzle, or too quickly towards print target 250. In the scenario shown, instead of achieving intended print pattern 254 of FIG. 3, a straight line with no wavy edges, occlusions, or voids in the print, the system in FIG. 4 produces unacceptable print pattern 256. Unacceptable print pattern 256 includes at least one of voids 257, where ink droplets 241 failed to fill in the pattern properly, and wavy or uneven edges 258, where ink droplets 241 failed to maintain the intended straight edge. If an image or text is being printed, unacceptable print patter 256 could have an unclear, "out of focus" appearance.

Figure 5:
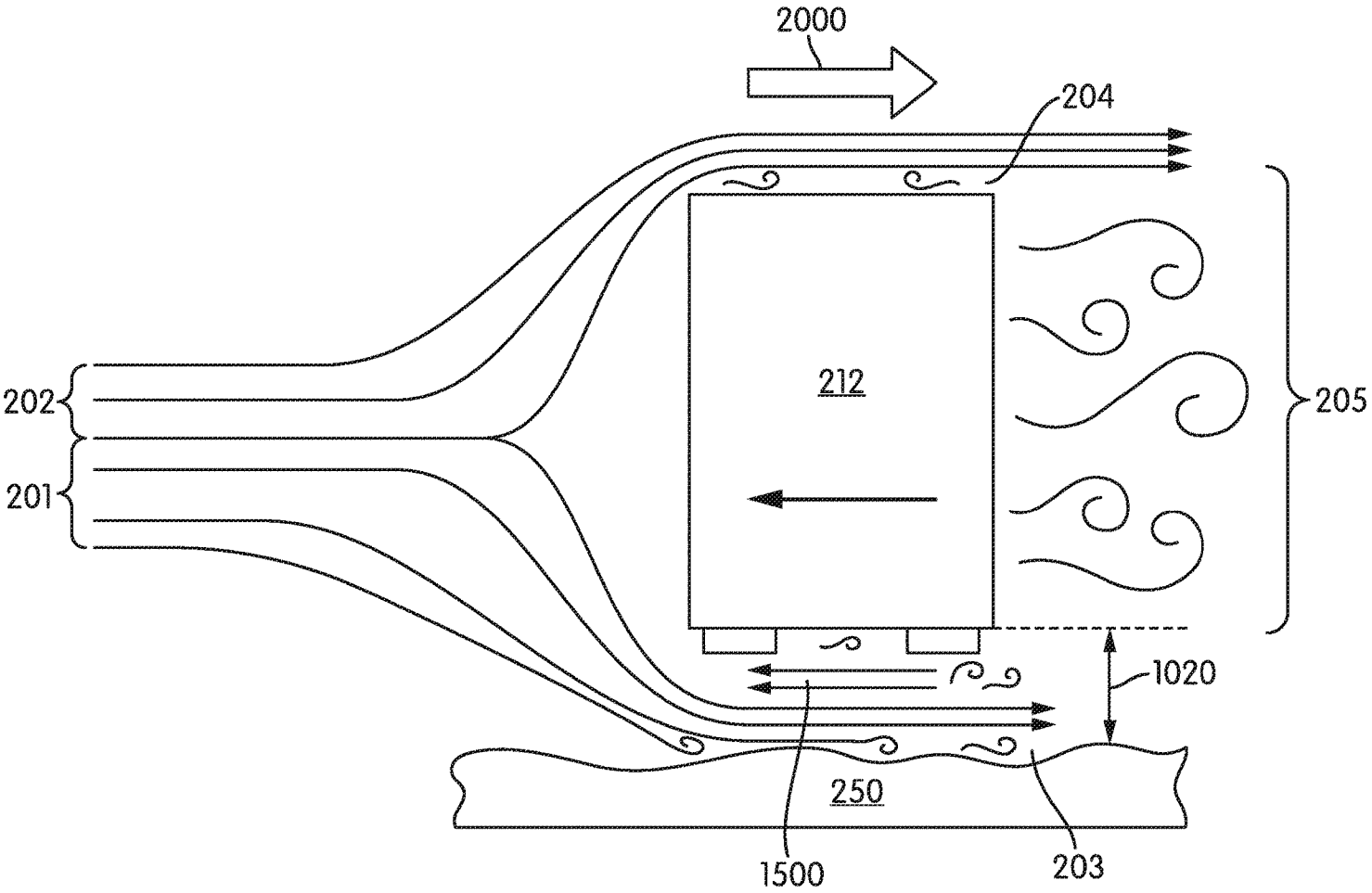
FIG. 5 is a schematic side view of a conventional printer head showing the flow pattern around the printer head in a lead direction.
Figure 6:
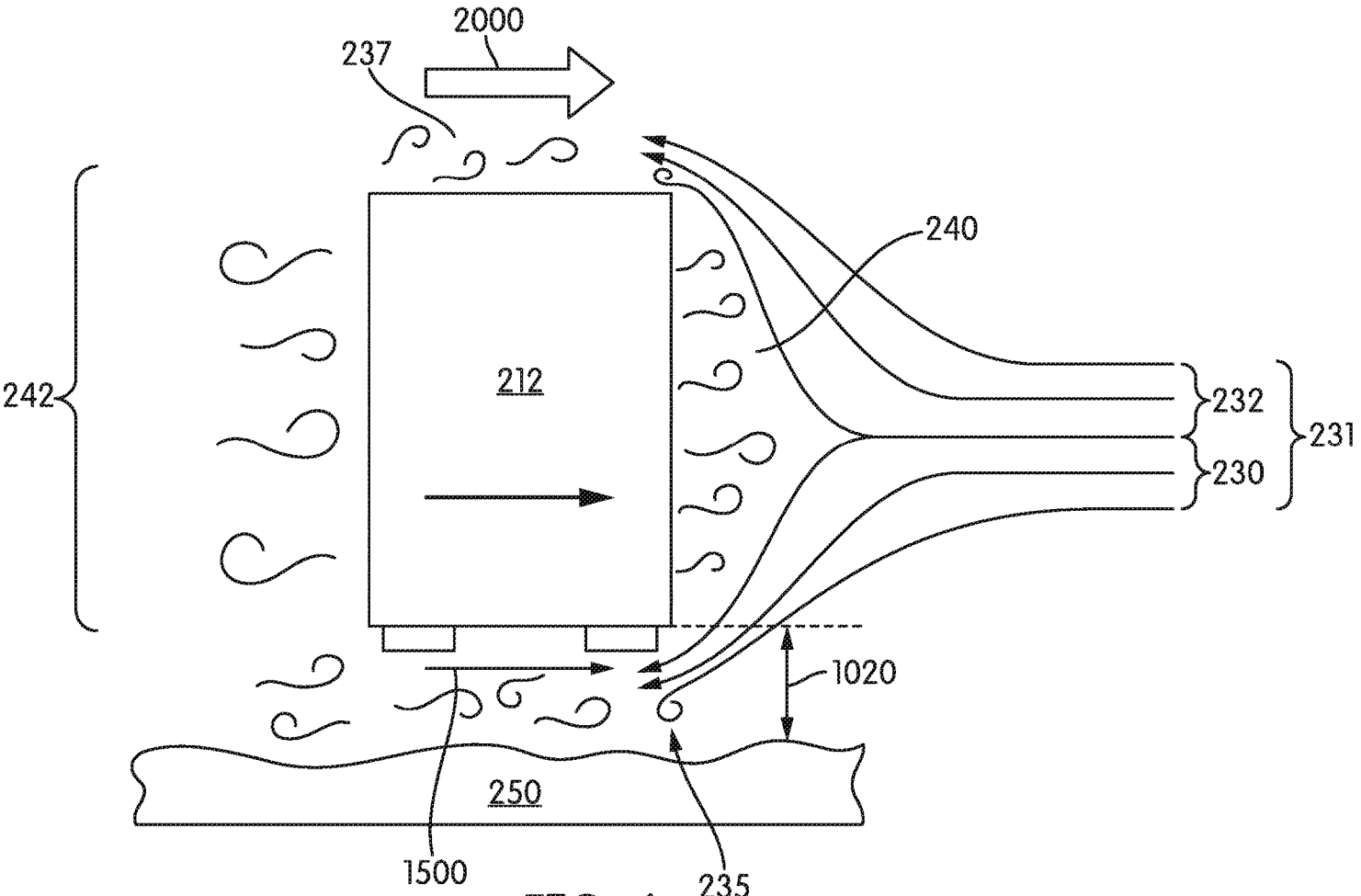
FIG. 6 is a schematic side view of a conventional printer head showing the flow pattern around the printer head in a trailing direction.

FIGS. 5 and 6 show some of the aerodynamic forces that can potentially impact the trajectory of ink droplets in the print gap. FIG. 5 shows printer head 212 moving in the return direction (opposite to print direction 2000), as shown by the arrow on printer head 212. When moving in the return direction, printer head 212 is not dispensing ink. Printer head 212 is moving as quickly as possible to an initial printing position. Printer head 212 may be moving faster in the return direction than when printer head 212 is moving in the print direction. Because printer head 212 may be considered a blunt body from an aerodynamic perspective, the air mass in front of printer head 212 as printer head 212 moves is split evenly into two air masses: a top air mass 202 and a bottom air mass 201. Top air mass 202 is pushed toward and flows over the top of printer head 212. Top air mass 202 may generate some top turbulence 204 proximate the top of printer head 212. A return wake 205 is formed behind printer head 212.

Bottom air mass 201 is pushed towards and flows underneath the bottom of printer head 212. The direction of flow is in print direction 2000. The bottom of printer head 212 faces print target 250, so bottom air mass 201 flows through the print gap having a print distance 1020. While in the print gap, bottom air mass 201 is influenced by the typically uneven surfaces of the bottom of printer head 212 and print target 250. In some circumstances, print target 250 may be smooth. However, in many circumstances, such as when print target 250 is an article of footwear or an article of apparel, print target 250 has a very uneven surface that may include depressions and projections. Similarly, the bottom of printer head 212 will generally have protruding nozzles for dispensing ink, though the bottom of printer head 212 may have other protrusions and depressions. These depressions and projections aerodynamically influence the flow of air through the print gap and can cause bottom turbulence 203.

Adding to the aerodynamics in the print gap, Couette flow 1500 may be generated by the movement of printer head 212 over stationary print target 250. Couette flow 1500 is in the direction that printer head 212 is moving. In FIG. 5, Couette flow 1500 is opposite to print direction 2000. Therefore, Couette flow 1500 is flowing in an opposite direction to the flow of bottom air mass 201 though the print gap, though the magnitude and strength of Couette flow 1500 is likely much less than that of the flow of bottom air mass 201. When Couette flow 1500 encounters the flow of bottom air mass 201, these opposite flows contribute to bottom turbulence 203.

FIG. 6 shows printer head 212 moving in print direction 2000, which is the opposite direction to the movement of printer head 212 in FIG. 5. When printer head 212 is moving in print direction 2000, ink is being dispensed. For the sake of clarity, FIG. 6 does not show ink being dispensed. The effects on the ink droplets are shown and described above with respect to FIG. 4.

Similar to printer head 212 shown in FIG. 5, because printer head 212 in FIG. 6 may be considered to be a blunt body, the air mass 231 in front of printer head 212 as printer head 212 moves is split evenly into two air masses: a second top air mass 232 and a second bottom air mass 230. Second top air mass 232 is pushed toward and flows over the top of printer head 212. Second top air mass 232 may generate second top turbulence 237 proximate the top of printer head 212. A second wake 242 is formed behind printer head 212.

Because the movement in the return direction shown in FIG. 5 generated air currents, such as Couette flow 1500, return wake 205, and other turbulence, remnants of these flows remain proximate printer head 212 even after printer head 212 reverses direction. For example, remnant turbulence 240 may be remnants of return wake 205. As air mass 231 encounters remnant turbulence 240, remnant turbulence 240 may become larger in magnitude, size, and amount. Remnant turbulence 240 may also stir or mix second top air mass 232 and/or second bottom air mass 230. As these air masses are stirred, second top air mass 232 and/or second bottom air mass 230 may become unstable and more prone to turbulent flow.

Second bottom air mass 230 is pushed towards and flows underneath the bottom of printer head 212. The direction of flow is opposite print direction 2000. The bottom of printer head 212 faces print target 250, so second bottom air mass 230 flows through the print gap having print distance 1020. While in the print gap, second bottom air mass 230 is influenced by the typically uneven surfaces of the bottom of printer head 212 and print target 250. As discussed above, the depressions and projections or the bottom of printer head 212 and print target 250 aerodynamically influence the flow of air through the print gap and can cause second bottom turbulence 235 in the print gap. Because second bottom air mass 230 is already unstable or even turbulent due to remnant turbulence 240, second bottom turbulence 235 may be even greater in magnitude, size, and amount than bottom turbulence 203 shown in FIG. 5.

Adding to the aerodynamics in the print gap, Couette flow 1500 is again generated by the movement of printer head 212 over print target 250. In FIG. 6, Couette flow 1500 is in print direction 2000. Therefore, Couette flow 1500 is flowing in an opposite direction to the flow of second bottom air mass 230 though the print gap, though the magnitude and strength of Couette flow 1500 is likely much less than that of the flow of second bottom air mass 230. When Couette flow 1500 encounters the flow of second bottom air mass 230, these opposite flows contribute to increasing the magnitude, size, and amount of second bottom turbulence 235.

Figure 7:
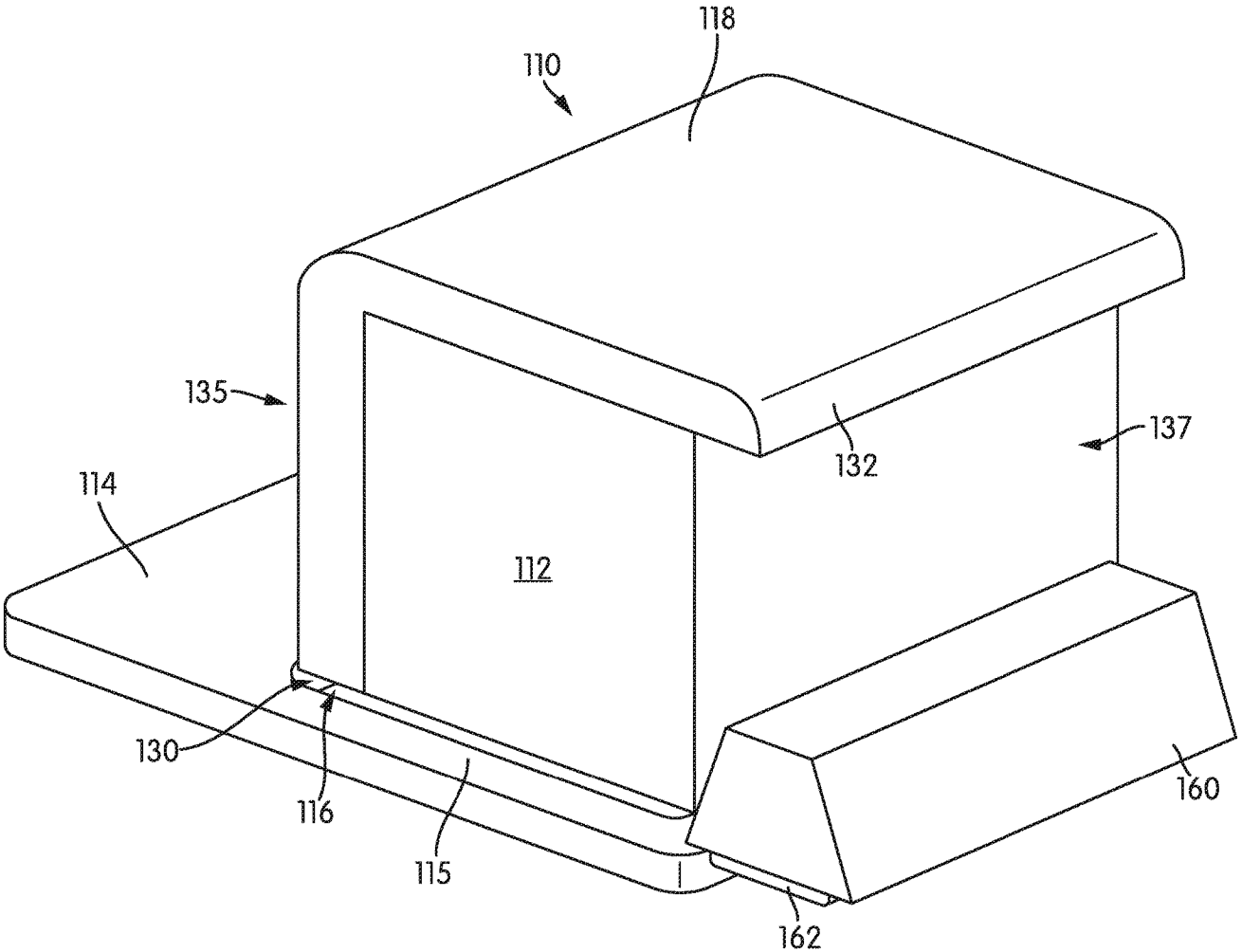
FIG. 7 is a schematic isometric view of a printer head with an airflow management system.
Figure 8:
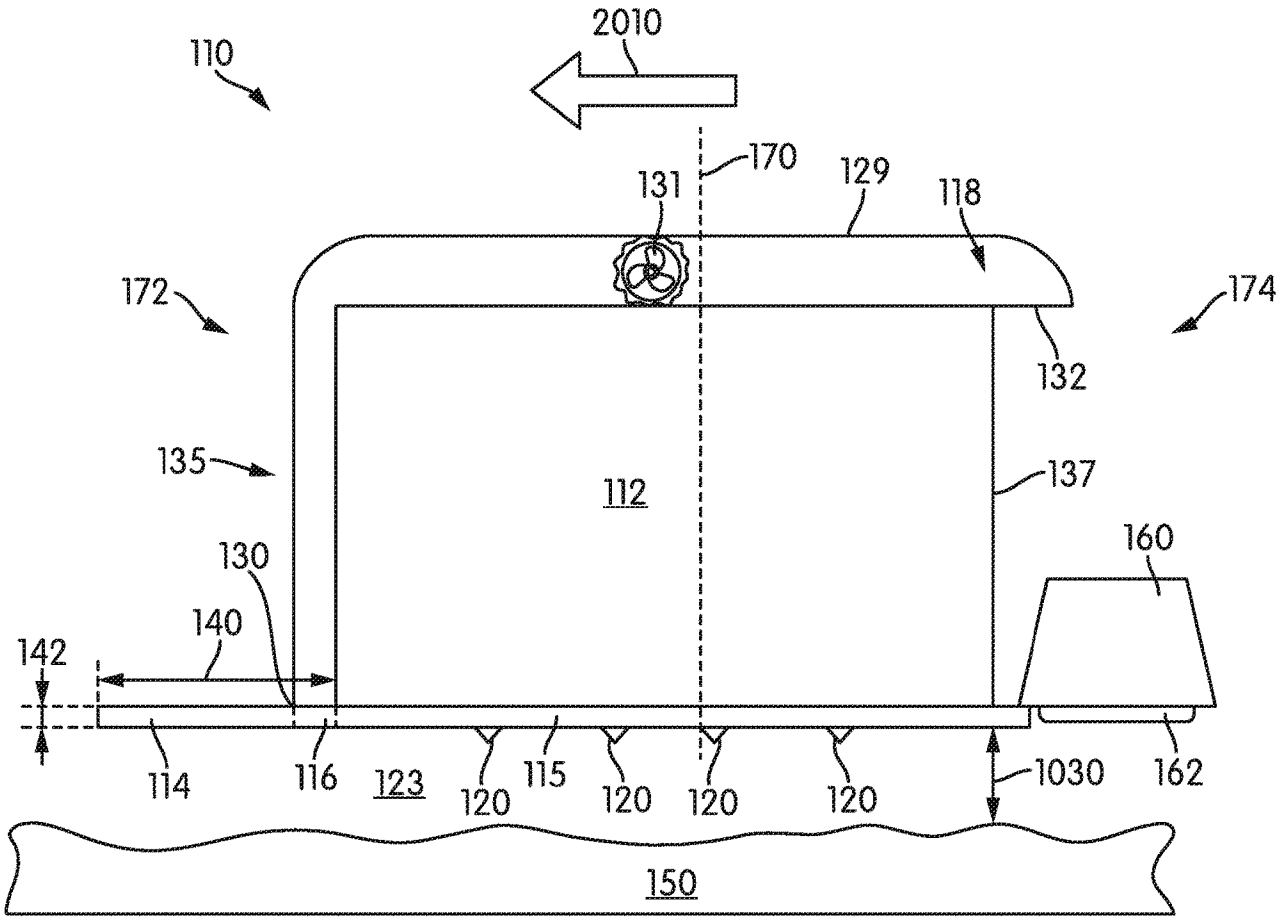
FIG. 8 is a schematic side view of a printer head with an airflow management system.
Figure 9:
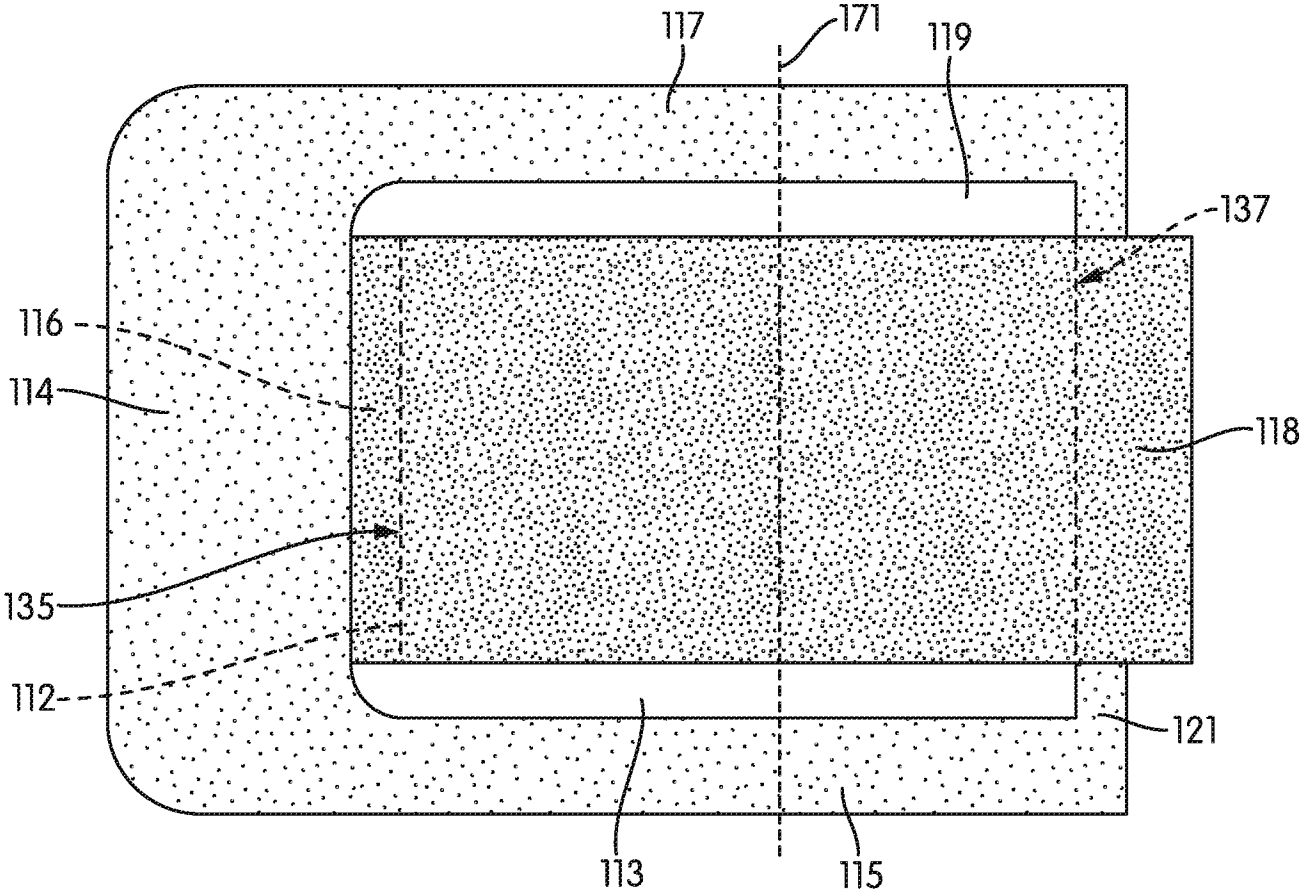
FIG. 9 is a schematic top view of a printer head with an airflow management system.

FIGS. 7, 8, and 9 show an embodiment of printer head 112 provided with an airflow management system. In some embodiments, the airflow management system may assist in managing the currents and turbulence generated in the print gap by the aerodynamic forces shown in FIGS. 5 and 6. In this embodiment, the airflow management system includes an air splitter 114, a first side member 115, a second side member 117 (shown only in FIG. 8), and a vacuum fan system 118. These components work individually and/or together to reduce the movement of air in print gap 123 to improve the print integrity while allowing print distance 1030 to be increased over traditional printers. In conventional systems, the print distance is generally limited to 1.5 mm, though some systems may allow print distances of up to 3 mm. Using an airflow management system such as the embodiments described below can permit a dramatic increase in print distance. In some embodiments, the print distance may be greater than 1.5 mm. In some embodiments, the print distance may be greater than 5 mm. In some embodiments, the print distance may be between 3 mm and 22 mm.

In some embodiments, printer head 112 may be somewhat box-like in shape. In the embodiment shown in FIGS. 7-9, printer head 112 has a leading wall or edge 135 and a trailing wall or edge 137. Air splitter 114 extends away from leading edge 135 a distance 140. In some embodiments, such as in the embodiment shown in FIGS. 7-9, air splitter 114 may be substantially perpendicular to leading edge 135. Distance 140 may be any desired distance, but in some embodiments, such as those shown in the figures, is less than the distance between leading edge 135 and trailing edge 137. Air splitter 114 may have any height 142, but in some embodiments is relatively thin compared to the height of printer head 112 so as to easily slice through the air in front of printer head 112 as printer head 112 moves in print direction 2000. In some embodiments, air splitter 114 is a flat plate as shown in the figures. In other embodiments, air splitter 114 may have other shapes, such as a curved plate, an air foil, or other shape. Air splitter 114 may be made of any material having sufficient rigidity to maintain its position with respect to printer head 112 and not to flex while printer head 112 is moving. For example, in some embodiments, air splitter 114 may be made of a material that includes metal, plastic, ceramic, and/or composite materials.

Some embodiments may include provisions for managing air in other regions or areas of printer head 112. For example, in the embodiments shown in FIGS. 7-9, a first side member 115 and a second side member 117 may be provided. Similar to air splitter 114, in some embodiments, first side member 115 and second side member 117 extend away from side walls of printer head 112. In some embodiments, first side member 115 and second side member 117 extend orthogonally away from printer head 112.

Figure 10:
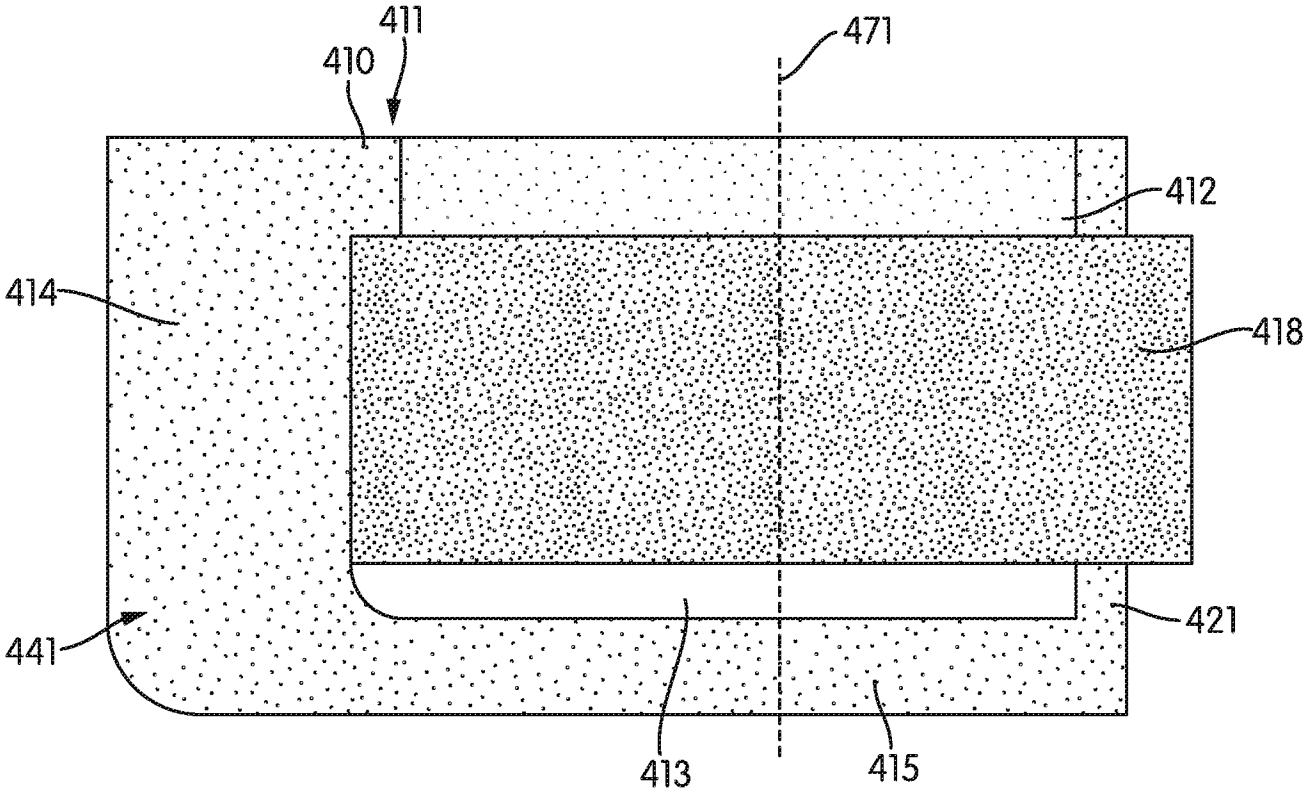
FIG. 10 is a schematic top view of a printer head with an airflow management system having only one side member.

In some embodiments, such as the embodiment shown in FIG. 10, only one of first side member 115 and second side member 117 may be provided, due to space considerations or if the printing is unevenly distributed so that only one side member provides an airflow benefit with respect to preserving printing integrity. First side member 115 and second side member 117 may be made of a similar material as air splitter 114, a material that has sufficient rigidity to maintain its position with respect to printer head 112 and not flex while printer head 112 is moving.

In the embodiment shown in FIGS. 7-9, first side member 115 and second side member 117 are symmetrical. However, in other embodiments, the printer head lacks side-to-side symmetry, i.e., is asymmetric about an axis that extends along the duct to divide the printer head into a first side portion and a second side portion. For example, either first side member 115 or second side member 117 may be larger than the other side member. In another example, such as shown in FIG. 10, printer head 112 lacks side-to-side symmetry because only one side skirt is provided.

In the embodiment shown in the figures, air splitter 114, first side member 115, and second side member 117 are formed as a single unit so that first side member 115 is continuous with and connected to air splitter 114. In other embodiments, other configurations are possible. Similarly, second side member 117 is continuous with and connected to air splitter 114. In other words, first side member 115, air splitter 114, and second side member 117 form somewhat of a U-shape, with first side member 115 and second side member 117 forming the legs of the U that are connected by air splitter 114.

Some embodiments include provisions that allow air to be drawn from the print gap. Air splitter 114 is associated with printer head 112 so that a front separation 116 separates air splitter 114 and printer head 112. Similarly, first side member 115 is associated with printer head 112 so that a first side separation 113 separates first side member 115 and printer head 112. Second side member 117 is associated with printer head 112 so that a second side separation 119 separates second side member 117 and printer head 112. As will be discussed in greater detail below, each of these gaps facilitate the removal of air from print gap 123 by vacuum fan system 118.

Air splitter 114, first side member 115, and second side member 117 may be associated with printer head 112 using any type of structure known in the art. As shown in the figures, air splitter 114, first side member 115, and second side member 117 are a unitary piece of material that is associated with printer head 112 by rear member 121. In the embodiment shown in FIGS. 7 and 8, rear member 121 is also continuous with first side member 115 and second side member 117 so that the unitary piece of material includes all of air splitter 114, first side member 115, second side member 117, and rear member 121. In other embodiments, any or all of these elements may be individually formed and/or separate from and/or spaced apart from the other elements.

As shown best in FIG. 9, in some embodiments, rear member 121 is directly associated with trailing edge 137 of printer head 112 using any type of connector or connection system known in the art. This direct association on trailing edge 137 of rear member 121 allows for front separation 116, first side separation 113, and second side separation 119 to be contiguous and without obstructions in the separations. In some embodiments, rear member 121 may be associated with printer head 112 using easily removable means so that rear member 121 may be attached to and removed from printer head 112 multiple times without damaging printer head 112 and/or rear member 121. Such removable connectors may include clips, pins, screws, or other known removable connectors such as are well known in the art. In other embodiments, rear member 121 may be associated with printer head 112 using a permanent connector or connection method so that rear member 121 is fixedly attached to printer head 112 so that rear member 121 is not easily removed from printer head 112 without damage to printer head 112, rear member 121, and/or the connector. Such permanent connectors may include welds, adhesives, and co-forming printer head 112 with rear member 121.

In the embodiment shown in FIGS. 7-9, rear member 121 also provides a mounting surface for optional ink dryer 160. In some embodiments, optional ink dryer 160 may include a UV bulb 162 to cure the ink on print target 150 more rapidly than without optional ink dryer 160. Any conventional ink dryer may be provided. Optional ink dryer 160 may be associated with rear member 121 using any removable or permanent connectors, like those discussed above.

In the embodiment shown in FIG. 10, only one side member, singular side member 415, is provided along with an alternate air splitter 414. Second printer head 412 is otherwise similar to printer head 112. Second printer head 412 includes a second vacuum fan system 418 that is similar to vacuum fan system 118. In the embodiment shown in FIG. 10, singular side member 415 is associated with second printer head 412 with a second rear member 421, which is similar to rear member 121, discussed above. Alternate air splitter 414 is similar to air splitter 114, discussed above. Alternate air splitter 414 is positioned spaced apart from second printer head 412 to form alternate from separation 416. Singular side member 415 is positioned spaced apart from second printer head 412 to form alternate side separation 413. Singular side member 415 is associated with second printer head 412 in a manner similar to first side member 115. Alternate rear member 421 is directly associated with second printer head 412. Alternate rear member 421 is contiguous with singular side member 415; therefore, singular side member 415 is associated with second printer head 415 via alternate rear member 421. Singular side member 415 is also contiguous with a first side of alternate air splitter 414, so that alternate air splitter 414 is also associated with second printer head 412 via alternate rear member 421. In some embodiments with only one side member, to stabilize a second side 411 of alternate air splitter 414, a strut 410 extends from alternate air splitter 414 to second printer head 412 at location 417. In some embodiments, strut 410 may be made from the same material as alternate air splitter 414. In some embodiments, strut 410 may be contiguous with alternate air splitter 414, while in other embodiments, strut 410 may be separately formed from alternate air splitter 414.

Figure 11:
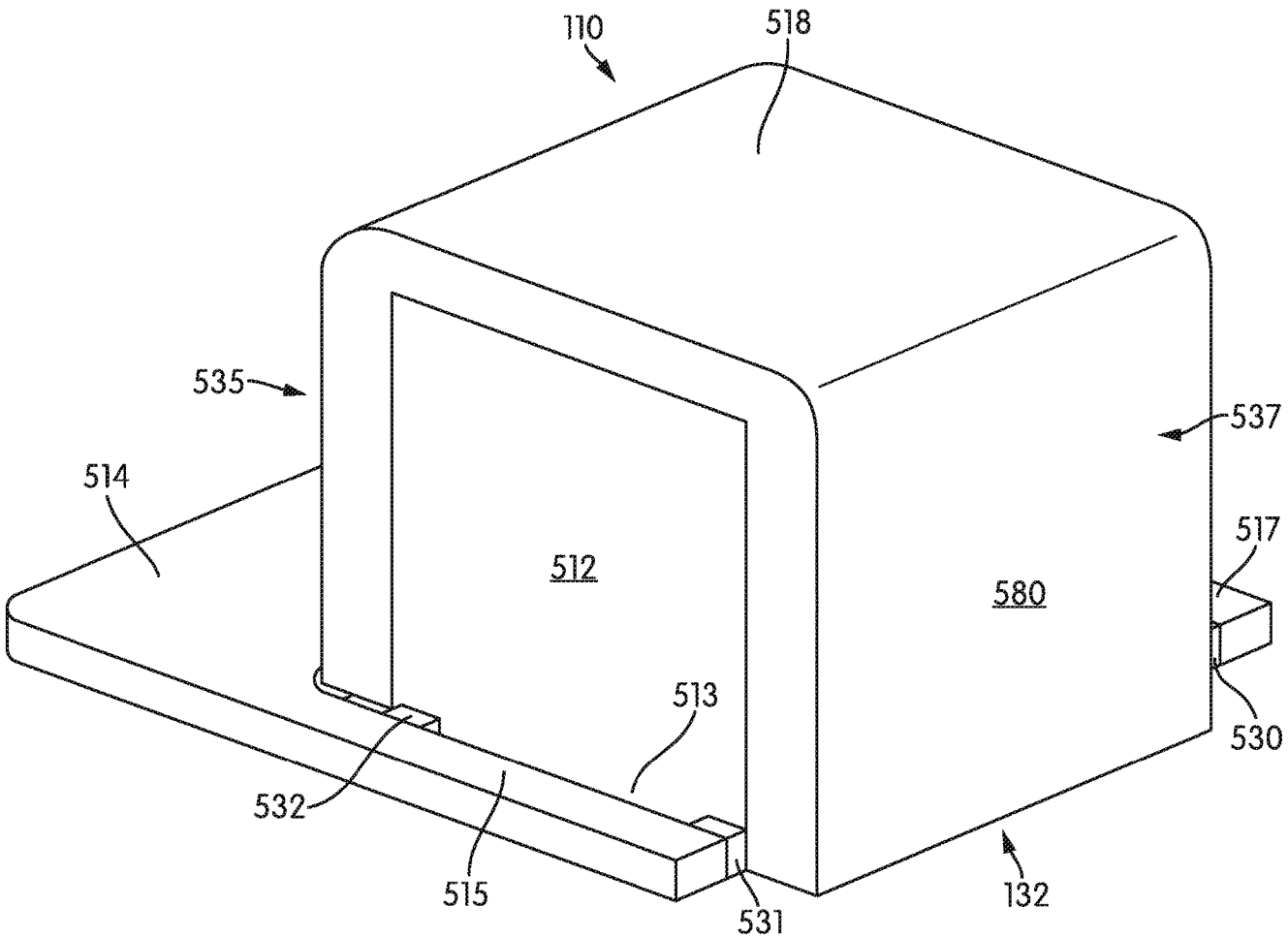
FIG. 11 is a schematic isometric view of a printer head with an airflow management system that employs struts to attach an airfoil and side members to the printer head.
Figure 12:
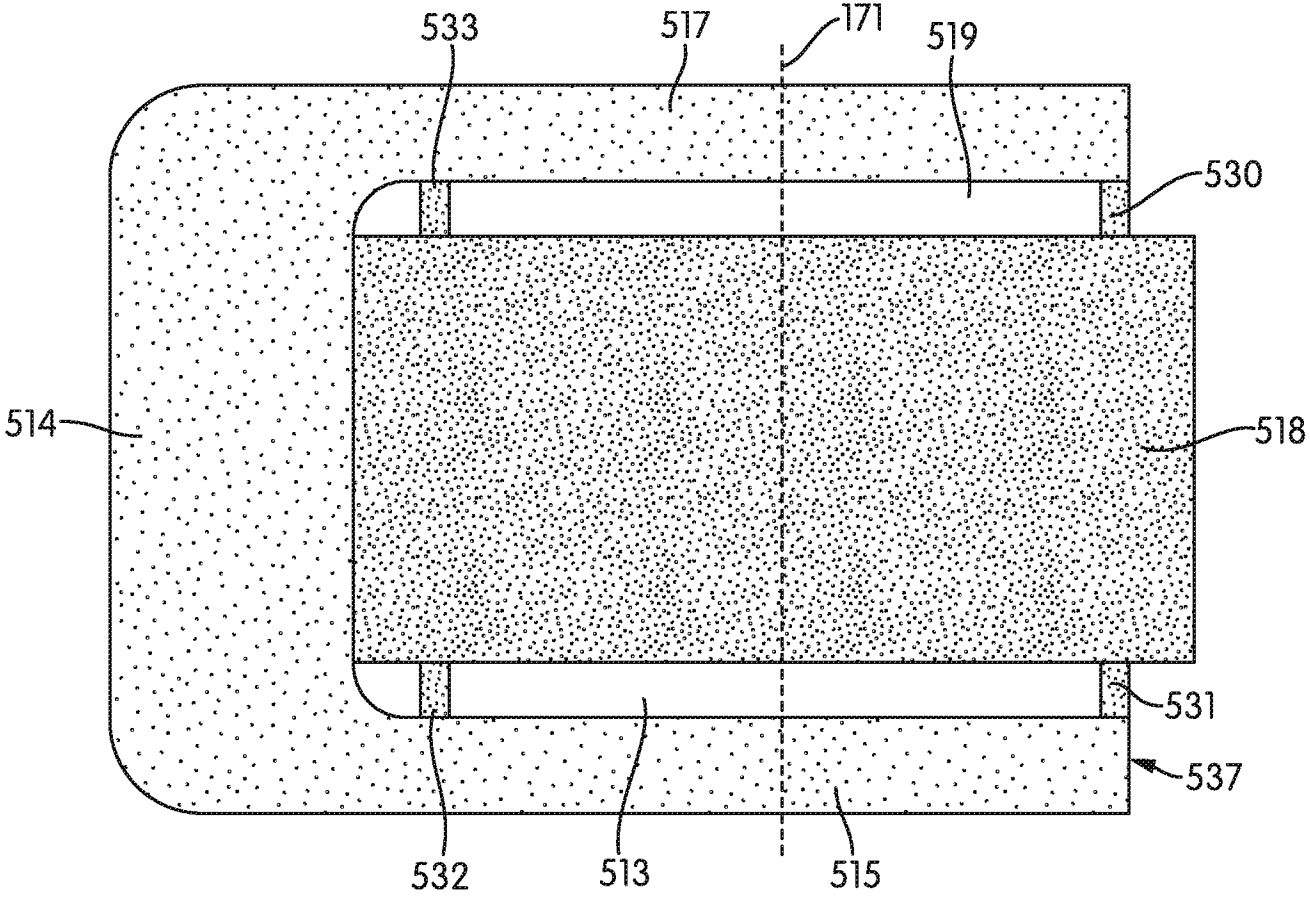
FIG. 12 is a schematic top plan view of a printer head with an airflow management system that employs struts to attach an airfoil and side members to the printer head.

In other embodiments, as shown in FIGS. 11 and 12, second alternate air splitter 514, alternate first side member 515, and alternate second side member 517 may be associated with third printer head 512 using other structures. For example, in some embodiments, rear member 121 may be omitted. In some embodiments, such as the embodiment shown in FIGS. 11 and 12, struts or other connecting members (not shown) may be provided to connect third printer head 512 to second alternate air splitter 514, alternate first side member 515, and/or alternate second side member 517. In some embodiments, the struts may be formed from the same material as and/or may be contiguous with second alternate air splitter 514, alternate first side member 515, and alternate second side member 517. In other embodiments, the struts may be separately formed from second alternate air splitter 514, alternate first side member 515, and alternate second side member 517.

As shown in FIGS. 11 and 12, a first strut 531 is positioned proximate trailing edge 537 of third printer head 512. First strut 531 extends from third printer head 512 to alternate first side member 515 across alternate first side separation 513. A second strut 532 is positioned proximate leading edge 535 of third printer head 512. Second strut 532 extends from third printer head 512 to alternate first side member 515 across alternate first side separation 513. A third strut 533 is positioned proximate leading edge 535, on an opposite side of third printer head 512 than second strut 532. Third strut 533 extends across alternate second side separation 519, from third printer head 512 to alternate second side member 517 across alternate second side separation 519. A fourth strut 530 is positioned proximate trailing edge 537 of third printer head 512, on an opposite side of third printer head 512 than first strut 531. Fourth strut 530 extends from third printer head 512 to alternate second side member 517 across alternate second side separation 519.

In some embodiments, vacuum fan system 118 is positioned on top of printer head 112, on an opposite side of the box of printer head 112 than nozzles 120. Vacuum fan system 118 generally includes a duct 129 that extends from leading edge 135 to at least trailing edge 137. In some embodiments, duct 129 includes an inlet 130 positioned proximate front separation 116 and a return port 132 positioned proximate trailing edge 137. In the embodiment shown in the figures, duct 129 is entirely coextensive with printer head 112. However, in other embodiments, duct 129 does not extend all the way across printer head 112 laterally, i.e., from first side separation 113 to second side separation 119.

A vacuum fan 131 is positioned within duct 129, at any position between inlet 130 and return port 132. In some embodiments, vacuum fan 131 may be positioned within inlet 130. In some embodiments, vacuum fan 131 may be positioned mid-way between inlet 130 and return port 132.

Vacuum fan 131 is generally configured to draw air from print gap 123 through one or all of front separation 116, first side separation 113, and second side separation 119. To facilitate drawing air through first side separation 113 and second side separation 119, duct 129 may include additional inlet ports between inlet 130 and return port 132 (not shown). Any such ports may include one-way valves so that air may be drawn into duct 129 through these side ports, but air cannot flow out of the side ports to potentially compromise the airflow management. Vacuum fan 131 may be any type of vacuum fan known in the art, and in some embodiments, is a commercially available vacuum fan. Vacuum fan 131 forces the air drawn into duct 129 through inlet 130 out of return 132. In some embodiments, return port 132 may be configured to blow the air away from printer head 112, such as by being angled away from the top of printer head 112, straight away from trailing edge 137, or any angle therebetween. In other embodiments, return port 132 may be angled so that the air is returned toward print gap 123 along trailing edge 137.

With the airflow management system, printer head 112 is asymmetrical as printer head 112 lacks front-to-rear symmetry. As shown in FIGS. 8 and 9, first center line 170 divides printer head 112 into forward portion or leading edge portion 172 and rear portion or trailing edge portion 174. Forward portion 172 includes air splitter 114, while rear portion 174 includes rear member 121. As shown, air splitter 114 is longer than rear member 121, which gives printer head 112 this lack of symmetry regardless of whether or not optional dryer 160 is included. Furthermore, in some embodiments, such as the embodiment shown in FIG. 7, duct 129 may extend beyond trailing edge 137 while duct 129 does not protrude beyond leading edge 135.

Adding to this lack of front-to-rear symmetry is that air splitter 114 is associated with printer head 112 to create front separation 116 while rear member 121 is associated directly with printer head 112. This lack of front-to-rear symmetry is shown best in FIG. 9, where second center line 171 divides printer head 112 in half.

Figure 13:
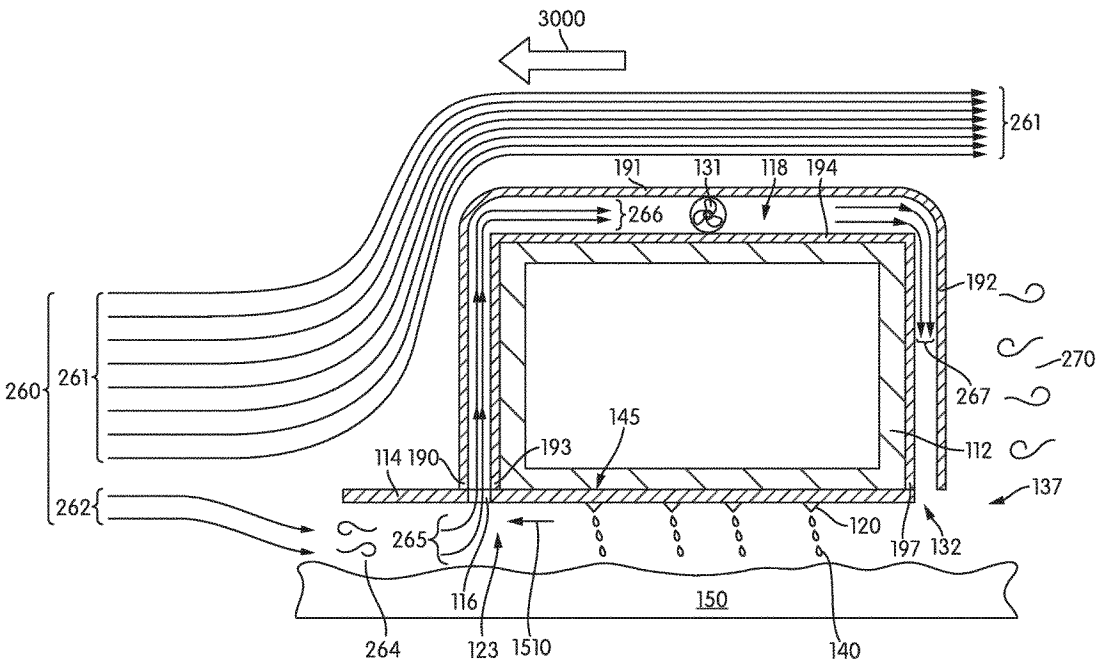
FIG. 13 is a schematic cross-sectional view of a printer head with an airflow management system showing the flow pattern around the printer head in a printing direction.

FIG. 13 shows the operation of the airflow management system in inhibiting undesirable pressure and airflow in print gap 123 that may negatively impact print quality. Printer head 112 is moving in print direction 3000 and dispensing ink droplets 140 onto print target 150 across print gap 123 in a specific trajectory.

As printer head 112 moves, printer head 112 encounters a forward mass of air 260. Air splitter 114 cuts through forward mass of air 260 and forces a main portion of air away from print gap 123. Due to the position of air splitter 114 directly above print gap 123 and proximate the bottom of printer head 112, this main portion of air represents a significant percentage of the air that would otherwise be pushed into print gap 123, e.g. second bottom air mass 230 shown in FIG. 6. In some embodiments, up to 95% of the air that would otherwise be pushed towards print gap 123 by the movement of printer head 112 is blocked and/or redirected by air splitter 114. In other embodiments, more or less of the air may be blocked and/or redirected by air splitter 114.

A first mass of air 261 is pushed entirely over the top of printer head 112 and vacuum fan system 118. A second mass of air 262 is pushed under air splitter 114 and into print gap 123, but second mass of air 262 is much less than the mass of air that would be entering or attempting to enter print gap 123 without air splitter 114. This reduces the amount of air available in the print gap to create turbulence over conventional printer heads. In conventional printer heads, the blunt front edge or face of the printer head acts as a well-understood blunt body in airflow. Half of the mass of air is pushed towards the top of the printer head, while the other half is pushed towards and into the print gap. Air splitter 114 reduces the mass of air pushed towards print gap 123 to create a low pressure region in print gap 123. This low pressure resists the generation of turbulence. The resistance to turbulence allows ink drops 140 to maintain the intended trajectory towards print target 150.

Additionally, vacuum fan system 118 draws a third mass of air 265 from print gap 123 through front separation 116. Removing third mass of air 265 from print gap 123 further reduces the air pressure in print gap 123 to create even greater resistance to the generation of turbulence in print gap 123. Third mass of air 265 mingles with third mass of air 263 in vacuum fan system 118 to combine to form duct flow 266. Shown in FIG. 14 and discussed in more detail below, vacuum fan system 118 may also draw air masses through first side separation 113 and second side separation 119. These air masses would also mingle with the other air masses in vacuum fan system to contribute to return flow 266.

The movement of printer head 112 over print target 150 may create Couette flow 1510 in print gap 123. Couette flow 1510 is airflow in the direction of movement of printer head 112. In FIG. 13, Couette flow 1510 is in the same direction as print direction 3000. However, because Couette flow 1510 is largely laminar, as long as Couette flow 1510 does not encounter opposite flow or turbulence, Couette flow 1510 can be accounted for readily by conventional processes. Any such opposite airflow would be from second mass of air 262. Because air splitter 114 has allowed only second mass of air 262 to enter print gap 123, the amount of airflow entering print gap 123 due to the movement of printer head 112 is reduced over conventional printer heads. As such, the impact of Couette flow 1510 on the print trajectory may be minimized or more readily accommodated.

Because Couette flow 1510 is also present between air splitter 114 and print target 150, Couette flow 1510 may contribute to the generation of front turbulence 264 when Couette flow 1510 meets second mass of air 262. Front turbulence 264 may also be produced because printer head 112 is translating back and forth, though typically only printing when moving in print direction 3000. When moving opposite to print direction 3000, printer head 112 may move faster than while printing to assume the proper start position for printing the next line of printing as quickly as possible. This movement creates a wake behind printer head 112, as shown and described above more generically with respect to FIG. 5. As shown and described more generically with respect to FIG. 6, when printer head 112 reverses to print direction 2000, printer head 122 can encounter a residual wake turbulence 240. This residual wake turbulence can contribute to front turbulence 264.

To help control and minimize the impact of front turbulence 264 on the airflow in print gap 123, third mass of air 265 can form a protective air curtain. When third mass of air 265 is drawn through front separation 116 by vacuum fan system 118, the flow of third mass of air 265 forms an air curtain proximate leading edge 135 that may reduce the impact of front turbulence 264 on the trajectory of ink drops 140 by either or both of preventing some or all of front turbulence 264 from passing through the air curtain and smoothing into laminar flow whatever portion of front turbulence 264 passes through the air curtain.

Return flow 266 forms a similar protective curtain of air proximate trailing edge 137. Because printer head 112 is moving in print direction P, wake turbulence 270 is formed. Return flow 266 helps to prevent wake turbulence 270 from impacting the trajectory of ink drops 140 by either or both of preventing some or all of wake turbulence 270 from passing through the air curtain or stirring the air beyond the air curtain and smoothing into laminar flow whatever portions of wake turbulence 270 or currents influenced by wake turbulence 270 pass through the air curtain produced by return flow 266.

Figure 14:
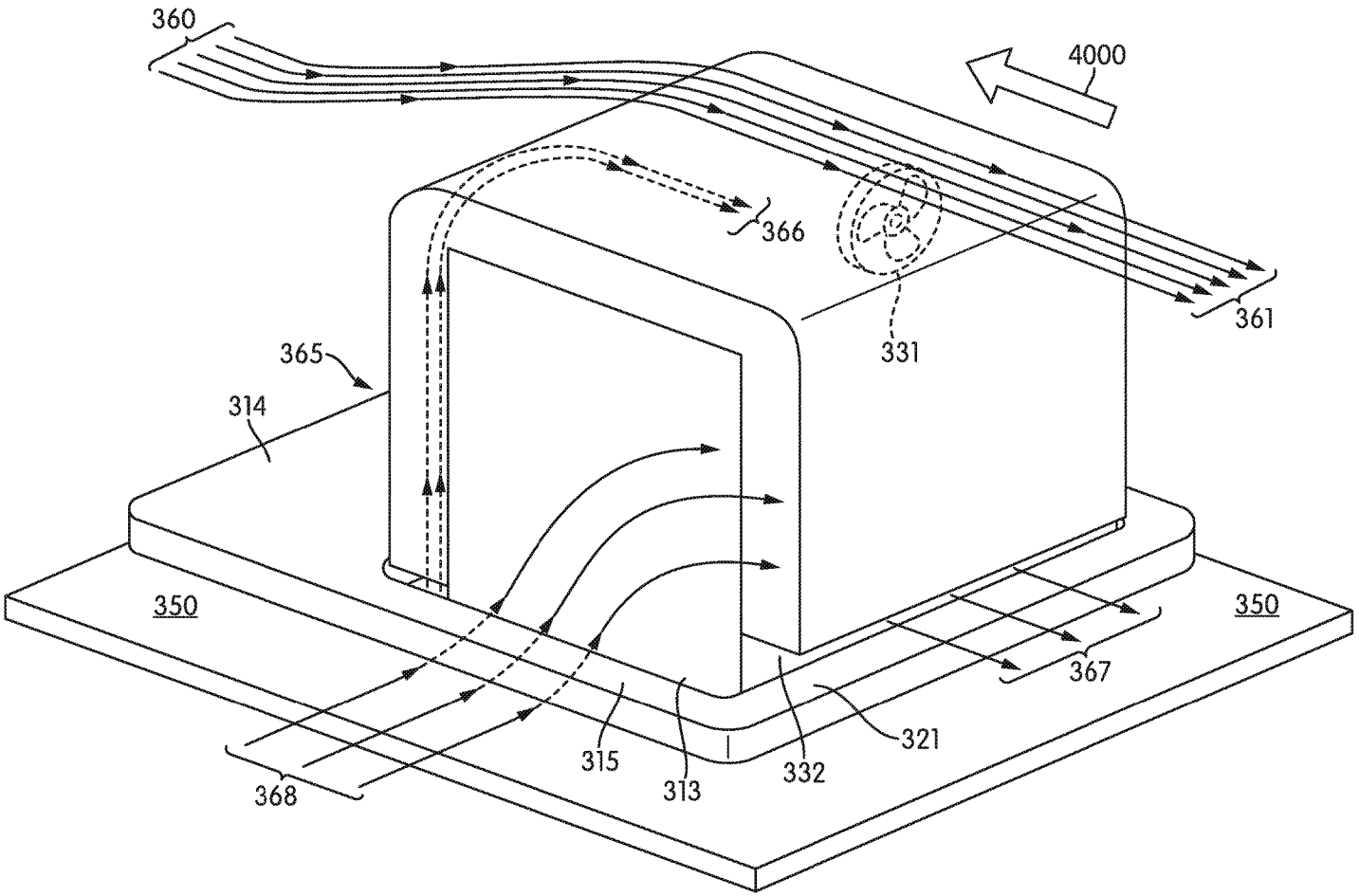
FIG. 14 is a schematic isometric view of a printer head with an airflow management system showing the flow pattern around a printer head that is moving in a printing direction.

FIG. 14 shows the airflow patterns caused by an embodiment of a vacuum system of an airflow management system around an embodiment of a printer head 312 when printer head 312 is moving in a print direction 4000. For the sake of simplicity, FIG. 14 does not show the airflow patterns in the print gap (also not shown) or the airflow patterns caused by an embodiment of an air splitter 314 and an embodiment of a first side skirt 315.

As in the embodiments discussed above, printer head 312 in this embodiment includes an air splitter 314 separated from printer head 312 by a front gap 316. Similarly, printer head 312 in the embodiment shown includes a side skirt 315 separated from printer head 312 by a side gap 313. Though not shown, another side skirt may be provided on an opposite side of printer head 312 from side skirt 315. Any side skirt is separated from printer head by a side gap.

In the embodiment of FIG. 14, the vacuum system generally includes a duct 318 extending along the length of printer head 312. In the embodiment shown, duct 318 has an inlet port 330 proximate the leading edge of printer head 312 and an outlet port 332 proximate the trailing edge of printer head 312. In this embodiment, a vacuum fan 331 is disposed within duct 318.

In some embodiments, side inlet ports may be provided to draw air into duct 318. While any number of side ports may be provided, in this embodiment, three side ports are provided: a first side port 381, a second side port 382, and a third side port 383. In some embodiments, duct 318 has a general shape with a top that is spaced apart from the top of printer head and side walls that extend from the duct top to the top of printer head. In this embodiment, first side port 381, second side port 382, and third side port 383 are wholly disposed in the side wall of duct 318, forming a hole though the side wall of duct 318. In other embodiments, side ports may be only partially disposed in the side wall of duct 318, so that the side ports extend, for example, onto the top of duct 318.

As printer head 312 moves in print direction 4000, the vacuum system encounters a forward mass of air 360. In the embodiment shown, vacuum 331 is configured to draw air into duct 318. A first portion 361 of forward mass of air 360 is pushed over the top of duct 318. A second portion 363 of forward mass of air 360 is drawn into duct 318 though inlet port 330 by the action of vacuum fan 331.

As printer head 312 moves and vacuum fan 331 draws air into duct 318, vacuum fan 331 may draw a side mass of air 368 through side gap 313 and into at least one of the side ports, for example, first side port 381, second side port 382, and third side port 383. Also, as printer head 312 moves in print direction 4000, front air splitter 314 pushes a small portion of air toward the print gap, similar to the embodiments discussed above. To inhibit unwanted air flow in the print gap, vacuum fan 331 draws a front mass of air 365 through front gap 316 and into duct 318 through inlet port 330.

In some embodiments, front mass of air 365 mingles with second portion 363 and/or side mass of air 368 to form duct flow 366. Duct flow 366 flows towards outlet port 332. In some embodiments, duct flow 366 exits duct 318 via outlet port 332. In some embodiments, duct flow 366 exits duct 318 via outlet port 332 to form rear flow 367. In some embodiments, rear flow 367 travels substantially along printer head 312 towards rear member 321. Rear flow 367 may have sufficient volume and flow speed to inhibit any wakes formed behind printer head 312 when printer head 312 moves in print direction 4000 from entering the print gap.

Additional details of printer 100 as shown in FIG. 1 are provided below for context and description of the printing process. Printer 100 may be used to impart graphics onto any type of article of manufacture. In general, the principles described here for applying graphics with printer 100 to articles are not limited to articles with any predetermined geometry and/or shape. Examples of articles that could be used with printer 100 include, but are not limited to: footwear, gloves, shirts, pants, socks, scarves, hats, jackets, as well as other articles. Other examples of articles include, but are not limited to: shin guards, knee pads, elbow pads, shoulder pads, as well as any other type of protective equipment and/or sporting equipment. Additionally, in some embodiments, the article could be another type of article, including, but not limited to: balls, bags, purses, backpacks, as well as other articles that may not be worn. In some embodiments, the components of these articles may be printed. In some embodiments, the article of or component of the article may be positioned on a tube or other platform for manufacturing and/or printing of the graphic or graphics via printer 100. For example, such a system is shown and described in Turner, U.S. Patent Publication Number 2013/0340484, titled "Knit Article of Apparel and Apparel Printing System and Method", published on Dec. 26, 2013, the disclosure of which is hereby incorporated by reference.

Printer 100 may utilize various types of printing techniques. These can include, but are not limited to: toner-based printing, liquid inkjet printing, solid ink printing, dye-sublimation printing, inkless printing (including thermal printing and UV printing), MEMS jet printing technologies as well as any other methods of printing. In some embodiments, printer 100 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements. In one embodiment, printer 100 may utilize an inkjet printer in which ink droplets may be sprayed onto a print target or substrate, such as an article of manufacture. Using an inkjet printer allows for easy variation in color and ink density. This arrangement also allows for some separation between the printer head and the target object, which can facilitate printing directly to objects with some curvature and/or surface texture.

In the embodiment shown in FIG. 1, printer 100 generally includes a housing 102 configured to support a rail 104, which rail 104 is configured to support a truck 110. Housing 102 may also include a motor for propelling truck 110 along rail 104, control electronics, input/output systems, power supplies, ports for inputs from computers, network systems, and data storage devices, ports leading to additional ink or toner reservoirs, and other systems useful in printing stock or custom designs onto articles (none of which are shown, for the sake of simplicity.) Housing 102 may have any configuration necessary to accommodate these systems and rail 104. Housing 102 may be made of any material, but it is anticipated that housing 102 is made from a plastic or metal material that is sufficiently rigid to withstand years of printing on an industrial scale.

Housing 102 is mounted, either fixedly or removably, to a platform 106. Platform 106 is configured to support housing 102 and also mounting surface 108. Mounting surface 108 is configured to receive the article to be printed. Mounting surface 108 may be configured to receive the article directly, such as by having clamps or other holding devices (not shown). In some embodiments, mounting surface 108 may include provisions to help hold an article in place in order to facilitate alignment and printing of a graphic onto the article. In some embodiments, for example, mounting surface can include a holding assembly, which may comprise a stand, fixture, holder, or similar type of device that is capable of holding an article in a predetermined position and/or orientation. In one embodiment, printing system includes a holding assembly that acts as a fixture for an article of footwear by holding an article in place during a printing process. Additionally, as described below, the holding assembly may also include provisions to prepare a portion of an article for printing, such as provisions to flatten one or more portions of an article of footwear. Mounting surface 108 and/or a mounting holder may be adapted to receive a tube for printing, as discussed above, to increase production speed by decreasing the number of steps needed during manufacturing (i.e., eliminating the need to remove the article from the tube and position the article in printer 100 or onto another mount for positioning in printer 100.)

Platform 106 may be configured to be positioned on a manufacturing floor, in a retail outlet, or in a consumer location, such as a residence. In some embodiments, platform 106 may be associated with a base (not shown). The base may comprise a substantially flat surface for mounting platform 106. In some embodiments, for example, the base may be a table top. In some embodiments, the base may be a fixture that associates platform 106 with a floor. Platform 106 may be removably secured to the base, such as with bolts, removable pins, latches, or other non-permanent securing mechanisms, or platform 106 may be fixedly secured to the base, such as by welding, with adhesives, or other securing mechanisms that would require the destruction of either the securing mechanism, the base, and/or platform 106 in order to separate the base from platform 106. Similarly, the base may be removably or fixedly secured to another surface, such as a table top, a fixture, or a floor.

In some embodiments, printer 100 may be mounted to tracks 103 of platform 106. In some embodiments, printer 100 is mounted in a movable manner to platform, so that printer 100 is capable of sliding along tracks 103. This allows printer 100 to move between a first position, in which printer 100 is disposed away from mounting surface 108 (as shown in FIG. 1), and a second position, in which printer 100 is disposed over mounting surface 108 (not shown). With this arrangement, alignment of a graphic on an article may be done while printer 100 is in the first, or inactive, position. Once the graphic alignment has been completed, printer 100 may be moved to the second, or active, position. In this active position, printer 100 may be disposed directly over mounting surface and may be configured to print a graphic onto an article that is disposed on platform 140.

While the current embodiment illustrates a configuration where printer 100 moves with respect to platform 106, while mounting surface 108 remains stationary, other embodiments could incorporate any other methods for moving printer 100 and mounting surface relative to one another. As an example, other embodiments could utilize a transfer system where a mounting surface could be moved to various positions, including a position under printer 100. An example of such a transfer system is disclosed in the alignment and printing case discussed above.

Provisions for aligning an article to ensure a graphic is printed on a desired region of the article can also be included. In some embodiments, printer 100 may include a computing system useful in such alignments. The term "computing system" refers to the computing resources of a single computer, a portion of the computing resources of a single computer, and/or two or more computers in communication with one another. Any of these resources can be operated by one or more users. In some embodiments, computing system 101 can include user input device 105 that allow a user to interact with computing system 101. Likewise, computing system 101 may include display 103. In some embodiments, computing system 101 can include additional provisions, such as a data storage device (not shown). A data storage device could include various means for storing data including, but not limited to: magnetic, optical, magneto-optical, and/or memory, including volatile memory and non-volatile memory. These provisions for computing system 101, as well as possibly other provisions not shown or described here, allow computing system 101 to communicate with and/or control various components of printer 100. For example, computing system 101 may be used to: create and/or manipulate graphics, control printer 100, control components of an alignment system (such as an LCD screen) as well as to possibly control systems associated with holding assembly 200.

For purposes of facilitating communication between various components of printer 100 (including computing system 101, printer 100, holding assembly 220, as well as possibly other components), the components can be connected using a network of some kind. Examples of networks include, but are not limited to: local area networks (LANs), networks utilizing the Bluetooth protocol, packet switched networks (such as the Internet), various kinds of wired networks as well as any other kinds of wireless networks. In other embodiments, rather than utilizing an external network, one or more components (i.e., printer 100) could be connected directly to computing system 101, for example, as peripheral hardware devices.

Printer 100 can include provisions for facilitating the alignment of a printed graphic onto article 102. In some embodiments, it may be useful to provide a user with a way of aligning an article with a printing system so as to ensure a graphic is printed in the desired portion (i.e., location) of the article. In particular, in some embodiments, printer 100 may include provisions for pre-aligning an article with a printer in such a way as to accommodate articles of various types, shapes and sizes. Examples of alignment systems that may be used to ensure that a graphic is printed onto the desired portion (or location) of an article are disclosed in Miller, U.S. Patent Application Publication Number 2014/0026773, published on Jan. 30, 2014, and titled "Projector Assisted Alignment and Printing," as well as in Miller, U.S. Pat. No. 8,978,551, issued Mar. 30, 2015, and titled "Projection Assisted Printer Alignment Using Remote Device," the entirety of both being herein incorporated by reference.

Any element of any embodiment described herein may be included with or substituted into any other embodiment unless specifically restricted. A variety of combinations and variations of any embodiment are encompassed by this disclosure.

While various embodiments have been described, the description is intended to be exemplary, rather than limiting and many more embodiments and implementations are possible that are within the scope of the embodiments. Accordingly, the embodiments are not to be restricted except in light of the attached claims and their equivalents. Also, various modifications and changes may be made within the scope of the attached claims and their equivalents.

The invention claimed is:

1. A printer head comprising:

a housing, wherein the housing has a leading edge associated with a print direction, a trailing edge on an opposite side of the housing from the leading edge, and a top that extends from the leading edge to the trailing edge;

at least one reservoir associated with the housing, wherein the reservoir contains a print medium;

at least one nozzle associated with the housing, wherein the reservoir is in fluid communication with the at least one nozzle, and wherein the at least one nozzle is configured to dispense the print medium onto a print target; and an airflow management system associated with the housing, wherein the airflow management system is configured to create a low pressure region and a low turbulence region between the printer head and the print target, wherein the airflow management system includes:

an air splitter associated with the leading edge so that a first gap is formed between the leading edge and the air splitter; and a first side member, wherein the first side member extends from the leading edge to the trailing edge, and wherein the first side member is associated with the housing so that a second gap is formed between the housing and the first side member;

wherein the printer head is asymmetric about at least one axis that extends through the printer head and wherein the at least one axis divides the housing into two equal portions;

the printer head further comprising a vacuum fan system, wherein the vacuum fan system is configured to draw air from the leading edge of the printer head through the first gap, wherein the vacuum fan system comprises:

a duct, wherein the duct extends from the leading edge to the trailing edge, wherein the duct includes an intake proximate the leading edge and a return proximate the trailing edge, and a vacuum fan, wherein the vacuum fan is disposed between the intake and the return.

2. The printer head of claim 1, wherein the airflow management system further comprises a second side member, wherein the second side member extends from the leading edge to the trailing edge, and wherein the second side member is associated with the housing so that a third gap is formed between the housing and the second side member.

3. The printer head of claim 1, wherein the second side member is disposed on an opposite side of the printer head than the first side member.

4. The printer head of claim 1, wherein the vacuum fan system is configured to return air to the trailing edge of the housing.

5. The printer head of claim 1, wherein the vacuum fan system is configured to return air to the trailing edge of the housing.

6. The printer head of claim 1, wherein the second gap is capable of allowing air to flow through the second gap from a lower side of the first side member to an upper side of the first side member.

7. A printer head comprising:

a housing, wherein the housing has a leading edge associated with a print direction, a trailing edge on an opposite side of the housing from the leading edge, and a top that extends from the leading edge to the trailing edge;

at least one reservoir associated with the housing, wherein the reservoir contains a print medium;

at least one nozzle associated with the housing, wherein the reservoir is in fluid communication with the at least one nozzle, and wherein the at least one nozzle is configured to dispense the print medium onto a print target; and an airflow management system associated with the housing, wherein the airflow management system is configured to create a low turbulence region between the printer head and the print target, wherein the airflow management system includes:

an air splitter associated with the leading edge so that a first gap is formed between the leading edge and the air splitter, the air splitter extending from the leading edge such that the air splitter is substantially perpendicular to the leading edge; and a first side member, wherein the first side member extends from the leading edge to the trailing edge, and wherein the first side member is associated with the housing so that a second gap is formed between the housing and the first side member;

wherein during use a leading edge turbulent region is formed between the leading edge of the housing and the print target, wherein the low turbulence region has less turbulence than the leading edge turbulent region;

the printer head further comprising a duct, wherein the duct extends from the leading edge to the trailing edge, wherein the duct includes an intake configured to receive air through the gap between the air splitter and the leading edge; and wherein a vacuum fan is disposed within the duct, the fan configured to pull air from the intake of the duct.

8. The printer head of claim 7, wherein the air splitter is configured to separate an air mass such that a first air mass extends over a top surface of the air splitter and a second air mass extends below a lower surface the air splitter.

9. The printer head of claim 7, wherein the duct extends over the top of the housing.

* * * * *